US005577348A

United States Patent [19]

Keller

[11] Patent Number: 5,577,348

[45] Date of Patent: Nov. 26, 1996

[54] PARTITION WALL WITH SLIDING TERMINATION PANEL

[75] Inventor: Otto Keller, Meisterschwanden, Switzerland

[73] Assignee: Rosconi AG, Villmergen, Switzerland

[21] Appl. No.: 504,429

[22] Filed: Jul. 20, 1995

Related U.S. Application Data

[63] Continuation-in-part of Ser. No. 246,821, May 20, 1994, Pat. No. 5,471,791.

[30] Foreign Application Priority Data

May 25, 1993 [CH] Switzerland ..... 1570/93
Feb. 3, 1995 [CH] Switzerland ..... 308/95

[51] Int. Cl.[6] ..... E06B 7/28

[52] U.S. Cl. ..... 49/317; 49/127; 52/64; 52/243.1; 160/40

[58] Field of Search ..... 49/317, 316, 127, 49/125; 52/64, 243.1, 241; 160/40

[56] References Cited

U.S. PATENT DOCUMENTS

| | | | |
|---|---|---|---|
| 3,072,975 | 1/1963 | Burmeister | 49/317 |
| 3,126,050 | 3/1964 | Lapof | 49/316 X |
| 3,280,526 | 10/1966 | Pepitone | 49/127 X |
| 3,295,257 | 1/1967 | Douglass | 49/127 X |
| 3,462,792 | 8/1969 | Greco | 49/127 X |
| 3,748,793 | 7/1973 | Tompkins et al. | 52/243.1 X |
| 4,454,690 | 6/1984 | Dixon . | |
| 4,535,578 | 8/1985 | Gerken | 49/317 X |
| 4,833,840 | 5/1989 | Kalischewski et al. | 52/243.1 X |
| 4,841,689 | 6/1989 | Schussler | 52/64 |

FOREIGN PATENT DOCUMENTS

| | | | |
|---|---|---|---|
| 948982 | 6/1974 | Canada . | |
| 0471596 | 2/1992 | European Pat. Off. . | |
| 2404875 | 8/1975 | Germany . | |
| 2653328 | 12/1977 | Germany | 49/127 |
| 4225849 | 9/1993 | Germany . | |
| WO83/00182 | 1/1983 | WIPO . | |

*Primary Examiner*—Philip C. Kannan
*Attorney, Agent, or Firm*—W. G. Fasse; W. F. Fasse

[57] ABSTRACT

A mobile partition wall includes several wall elements (1, 1') that are each suspended from a track (2) secured to the ceiling of a room. Each wall element is provided with coupling valves (30, 32) which pneumatically interconnect the wall elements to allow the continuous throughflow of compressed air. The compressed air actuates pneumatic stroke devices to press respective seal bars (8, 9) against the ceiling and the floor in order to achieve good noise insulation and stability of the wall elements. The terminal wall element (1') includes a laterally extendable sliding termination panel (70) that is connected to a pneumatic drive device for extending the termination panel from the wall element (1'). In this manner, any vertical gap remaining between the terminal wall element and a wall of the room can be simply close and sealed by the termination panel. Pneumatic valves are arranged to control the pressurization sequence of the pneumatic elements. An extension limit valve is actuated when the termination panel is extended against the room wall, and only then is the compressed air directed to the pneumatic stroke devices for extending the seal bars.

21 Claims, 5 Drawing Sheets

PARTITION WALL WITH SLIDING TERMINATION PANEL

CROSS-REFERENCE TO RELATED APPLICATION

This application is a Continuation-In-Part of U.S. patent application Ser. No. 08/246,821, filed on May 20, 1994 and issued as U.S. Pat. No. 5,471,791 (Keller) on Dec. 5, 1995. The entire disclosure of the parent application U.S. Ser. No. 08/246,821 is incorporated herein by reference.

FIELD OF THE INVENTION

The invention relates to a mobile partition wall including separate wall elements that are each movably supported from a support track mounted on the ceiling of a room, wherein each wall element has at least one seal member for achieving a seal when the wall element is in a deployed position. More particularly, each wall element includes a pneumatic stroke device and a pneumatic coupling member, whereby the pneumatic stroke device is coupled to a source of compressed air when the wall elements are pushed against one another in the deployed position.

BACKGROUND INFORMATION

The above mentioned parent application U.S. Ser. No. 08/246,821 discloses a mobile partition wall of a type within the above described field. The mobile partition wall disclosed in the parent application is very effective for partitioning a room in any desired configuration while achieving good noise insulation and good stability of the wall elements. Furthermore, when the partition wall is not needed, the wall elements may be stored in a very small space by being pushed along the tracks and then stacked closely together in a storage location. However, a vertical gap or space remains between the last wall element of the deployed partition wall and a stationary wall of the room, because the last wall element must be pushed a certain distance against the second-to-last wall element to achieve pneumatic coupling thereto. Thus, special measures or efforts have been required for closing this vertical gap in a satisfactorily sealed and noise insulating manner. It has been found that the ease of closing or sealing the gap could be improved.

OBJECTS OF THE INVENTION

In view of the above it is the aim of the invention to achieve the objects of the parent application U.S. Ser. No. 08/246,821 as well as the following additional objects, singly or in combination:

- to construct at least one terminal wall element of a mobile partition wall in such a manner that a vertical gap between the last wall element and a stationary wall of the room can be avoided or can be easily closed;
- to provide a sliding termination panel on a wall element to close and seal the gap between the last wall element and the stationary wall in a noise insulating and stable manner;
- to arrange pneumatically actuatable drive devices and actuator valves in a wall element in such a manner that the sliding termination panel is extended and pressed against the wall using the same compressed air that is provided for pressing the top and bottom seal bars against the ceiling and the floor;
- to provide a manually operable valve and an extension limit valve that cooperate in such a manner that the termination panel is extended only when the manual valve is actuated, and the floor and ceiling seal members of the terminal wall element are extended only after the termination panel has been extended to seal against the wall of the room whereupon the extension limit valve has been actuated; and
- to achieve such closing and sealing of the vertical gap between the last or terminal wall element and the stationary wall of the room in a structurally simple and compact manner, and to allow the sliding termination panel to be extended or deployed in a very simple, substantially automatic manner.

SUMMARY OF THE INVENTION

The above objects have been achieved in a partition wall using a wall element according to the invention. The present partition wall generally has the same construction as the partition wall described in the parent application U.S. Ser. No. 08/246,821, and further comprises a sliding termination panel provided on at least one of the wall elements in order to seal any gap remaining between that wall element and a stationary wall of the room in which the partition wall is deployed. The wall element according to the invention further comprises horizontally effective pneumatically actuatable piston cylinder devices and a manually operable control valve.

Compressed air is provided to the wall element through a pneumatic coupling member provided in a vertical side edge of the wall element. The manual control valve directs compressed air from the pneumatic coupling member to the piston cylinder devices to push the sliding termination panel laterally toward and against the stationary wall of the room. An extension limit valve provided on the termination panel is actuated by contacting the wall once the termination panel reaches its properly extended position. Thereby, the limit valve directs the compressed air flow to the pneumatic stroke devices that press the seal bars against the ceiling and the floor. More specifically, the top and bottom seal bars are only extended after the termination panel has been extended into its properly deployed position.

The sliding termination panel is laterally extended from the terminal wall element in a telescoping manner, using only the compressed air that is already provided to the wall element for extending the floor and ceiling seal bars. In other words, the invention provides a very simple manner of closing and sealing the vertical gap and does not require any additional compressed air supply connections or conduits, or any non-pneumatic drive elements.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
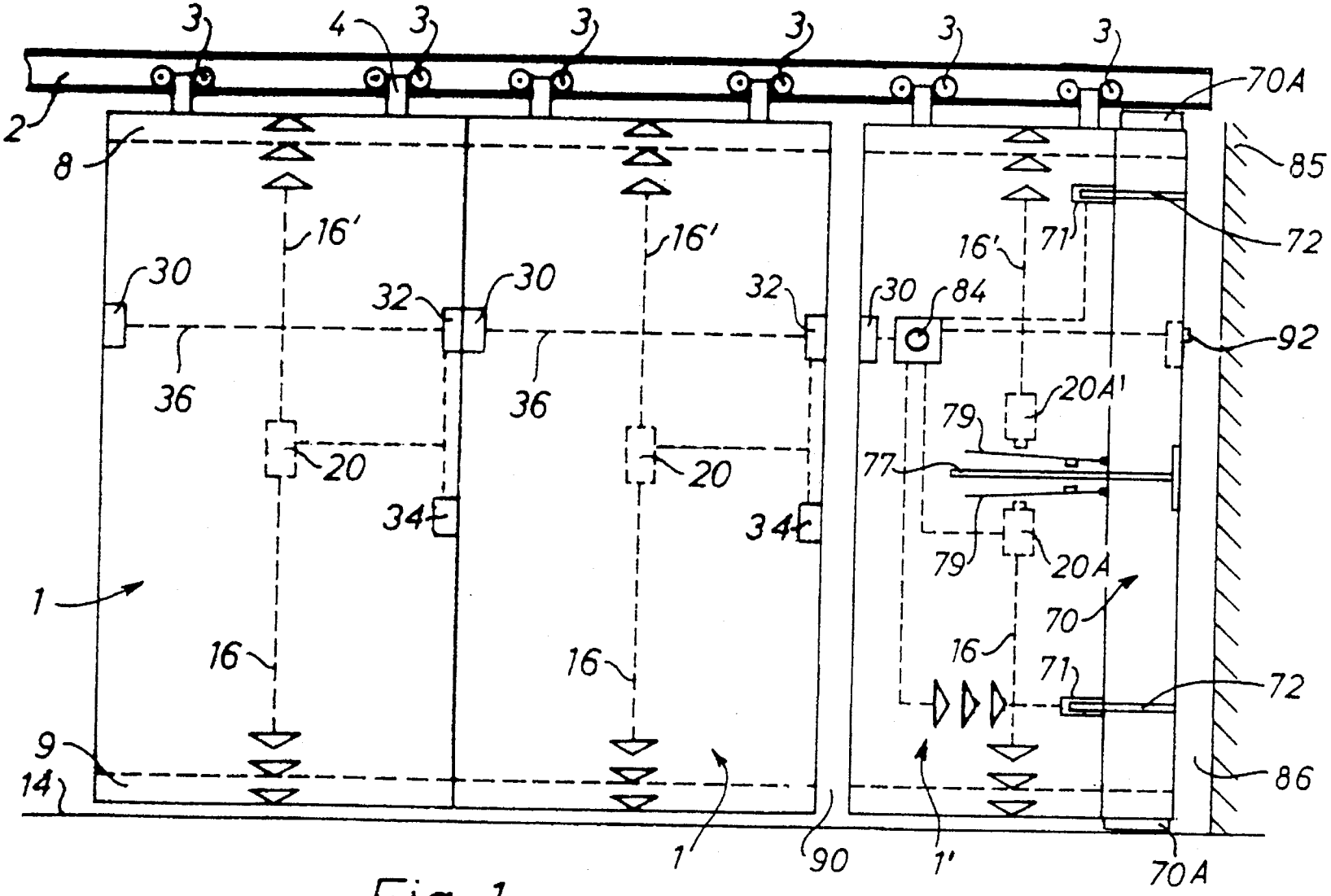
FIG. 1 is a schematic front view of a partition wall including a plurality of wall elements, and especially a terminal wall element, according to the invention.
Figure 2:
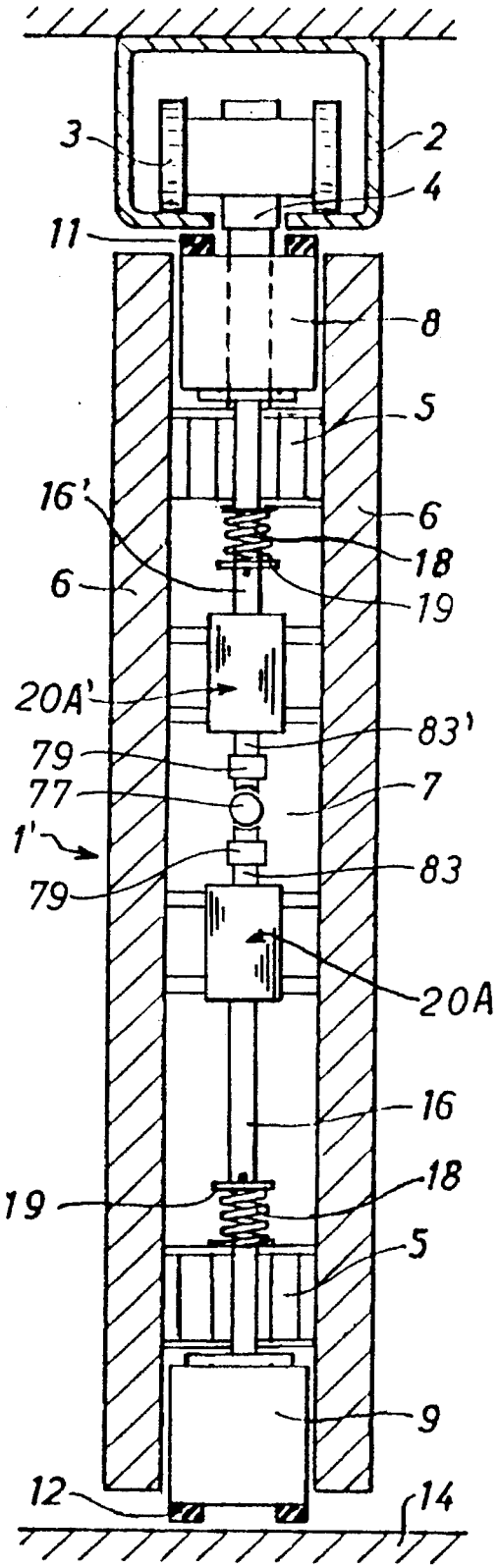
FIG. 2 is a vertical section through a terminal wall element according to the invention.

A complete partition wall as represented in FIG. 1 is made up of several independent panel-shaped wall elements 1 that may be substantially similar to those of the parent application hereof, for example, and at least one terminal wall element 1', which is shown in vertical section in FIG. 2. Each wall element 1 and 1' hangs from a support or guide track 2 that is secured to the ceiling of the room in which the partition wall is to be deployed. The guide track 2 is preferably a hollow sectional member, for example, having a C-shaped cross-section as shown in FIG. 2. Each wall element 1 and 1' comprises preferably two support carriages 3 having rolling balls or rolling wheels that ride along the support track 2. Each support carriage 3 is connected to the wall element 1 or 1' by a respective suspension member 4 connected to a horizontal support member 5 of the wall element 1 or 1'.

Each wall element 1 and 1' further includes a frame structure 22 (see especially FIG. 3) made of wood or metal and especially steel and/or aluminum, as well as two panels 6 held a certain interspacing 7 apart from one another, and carried on the frame structure 22 for example. The panels 6 can be made of various materials including steel, aluminum, glass, plaster, wood or synthetic materials, for example. The panels 6 may also comprise a sandwich or composite construction. Another possibility is to construct the wall element 1 or 1' as a steel frame structure with glazing panels attached thereto.

In order to seal the floor and ceiling clearance gaps and to tightly prop or clamp the wall element into its deployed position and thereby provide stability and noise insulation, a substantially rigid lower seal member or seal bar 9 is arranged at the bottom of the wall element 1 in the interspace 7 between the two panels 6, and a substantially rigid upper seal member or seal bar 8 is arranged at the top of the wall element 1 in the interspace 7 between the two panels 6. Both of the seal bars 8 and 9 are arranged to be vertically movable as described below. Flexible seal strips 11 are arranged on the top of the rigid upper seal bar 8, so as to be pressed against the support track 2 by the seal bar 8. Corresponding flexible seal strips 12 are arranged on the rigid lower seal bar 9 so that they can be pressed against the floor 14 by the seal bar 9.

The two seal bars 8 and 9 are connected to a linkage and actuator mechanism, including at least one stroke device 20 which is preferably a pneumatic device, and two rods 16 and 16' extending from the device 20 to the respective seal bars 9 and 8. Note particularly that the wall elements 1 each have a single stroke device 20 (FIG. 1) and the wall element 1' has a pair of stroke devices 20A and 20A' as described in detail below. The stroke device 20 may be a bellows device or a piston cylinder device. Compression springs 18 are arranged on the rods 16 and 16' to bear against the two horizontal support members 5 on the one hand and to bear against a respective stop 19 and 19' provided on the rods 16 and 16' on the other hand. Each stop 19 and 19' is preferably in the form of a washer or a crosswise pin or a combination thereof. In a resting state, the two compression springs 18 and 18' are slightly precompressed and urge the two seal bars 8 and 9 toward a retracted or non-sealing state. The particular details of the construction of the linkage and actuator mechanism are described more fully in the parent application U.S. Ser. No. 08/246,821.

Figure 4:
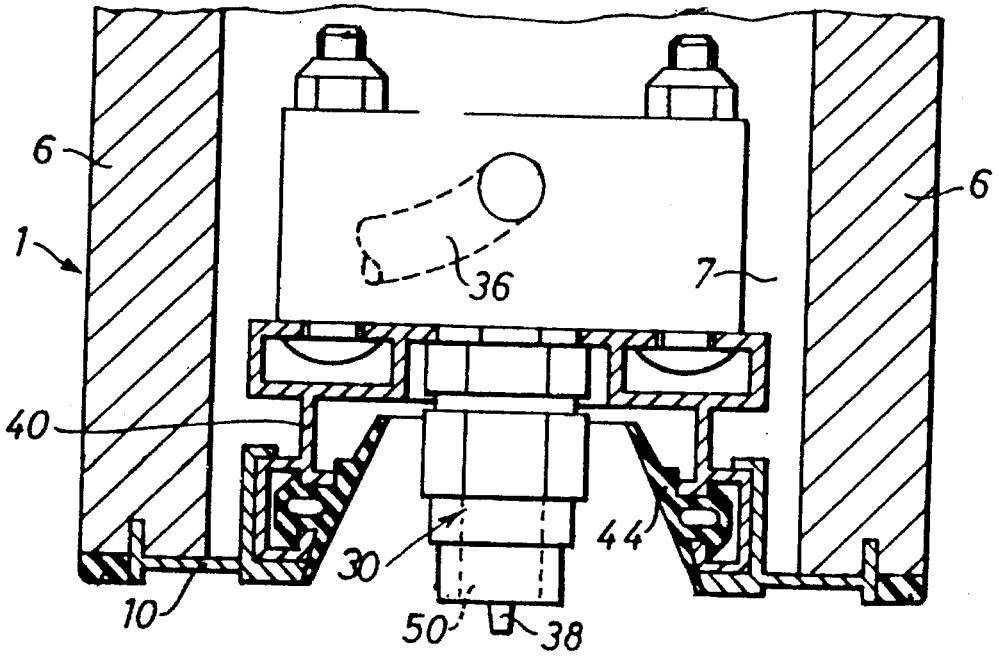
FIG. 4 is a view of a first pneumatic coupling member shown partially in section.
Figure 5:
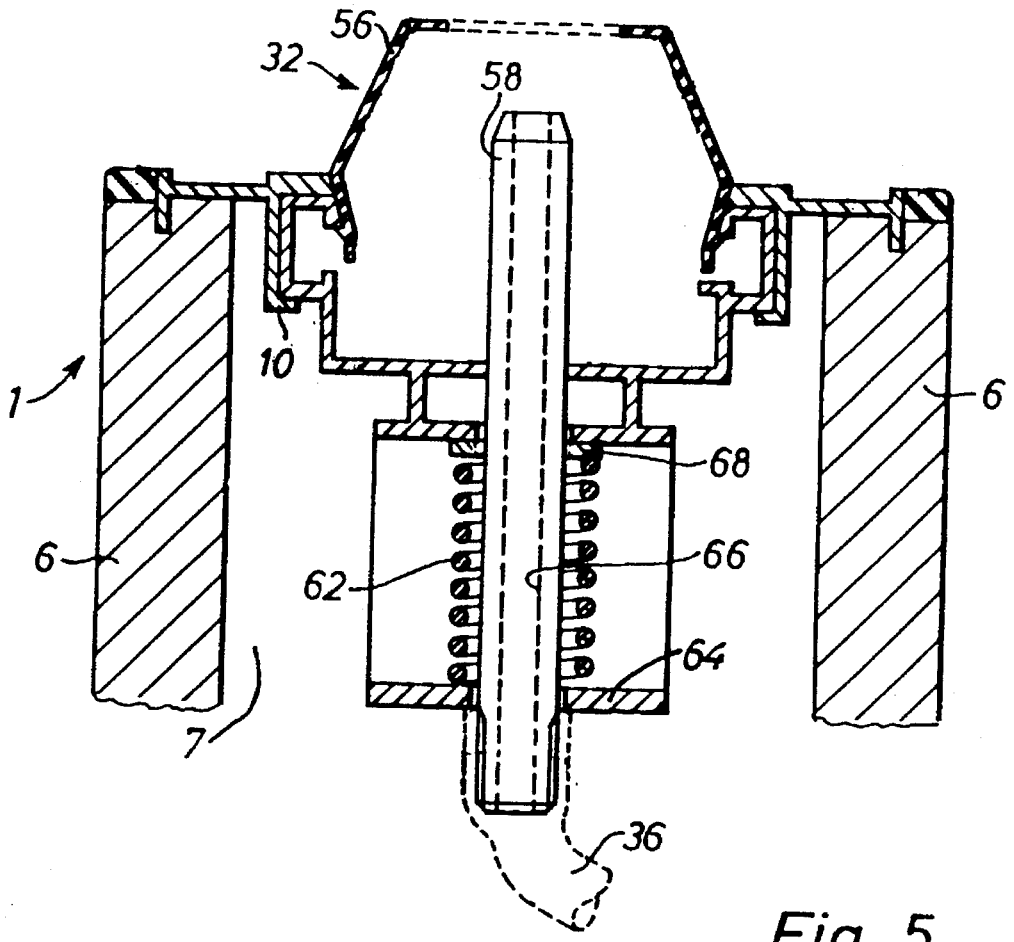
FIG. 5 is a view of a second pneumatic coupling member for engaging the first coupling member of FIG. 4, also shown partially in section.

As shown generally in FIG. 1, and in detail in FIGS. 4 and 5, two pneumatic coupling members or coupling valves 30 and 32 are arranged on the opposite side edges of the wall elements 1, and are arranged and configurated to cooperate or mate with one another. A single coupling member 30 is provided at one side edge of the terminal wall element 1'. The first coupling member 30 includes a non-return or poppet type valve which is generally known as such, and includes a valve element or a valve body 50 that is slightly or weakly spring loaded. The first coupling valve 30 is secured to a carrier rail 40, to which are attached two inclined or angled coupling guide and seal strips 44 made of an elastic or resilient material. Each seal strip 44 has a substantially planar shape extending vertically and inclining inwardly toward the axis of the valve body 50.

The second coupling valve 32 includes a protruding guide member or a tapered rail 56 that has an opening at the area of the coupling valve 30. The tapered rail 56 includes two substantially planar guide flanks, extending vertically and inclining outwardly toward the axis of the valve 32 to mate with the inclined strips 44 of the adjacent coupling valve 30. The tapered rail 56 is carried by a metal sectional frame member 10, for example. A valve bolt 58 is arranged within or behind the tapered rail 56 at the area of the opening facing the coupling valve 30. A spring 62 is held by a support 64 and biases the bolt 58 via a washer or disk 68 so that the bolt 58 is urged laterally outward from the side edge of the wall element 1. A central bored hole 66 passes through the bolt 58 and opens into a hose or conduit 36.

When the two coupling valves 30 and 32 are engaged with one another, the bolt 58 of the second coupling member 32 pushes the valve body 50 of the first coupling member 30 into the open position so as to open the valve and allow a through-flow of compressed air. When the two coupling valves 30 and 32 are disengaged from one another, the valve body 50 again moves into the closed position so as to stop the through-flow of compressed air. Thus, when two adjacent wall elements 1 are pushed against each other, the adjacent coupling members 30 and 32 cooperate to allow compressed air to flow through from one wall element to the next. A pneumatic hose or conduit for the compressed air runs crosswise through each wall element 1, i.e. extends from each coupling valve 30 to each respective coupling valve 32 arranged on the opposite edge of the wall element. Furthermore, when the adjacent coupling valves 30 and 32 are coupled together, compressed air flows through the bored hole 66 of the bolt 58 and through the hose or conduit 36 to the stroke device 20. When the two mating coupling valves are decoupled, the poppet valve or the non-return valve in the first coupling valve 30 closes and thereby interrupts the throughflow of compressed air.

As shown in FIG. 1, a manually operable decompression valve 34 is provided on at least one of the wall elements 1, preferably at a narrow side edge thereof. The valve 34 can be manually actuated to allow the compressed air to escape out of the pneumatic elements of the corresponding wall element 1. Due to this decompression, the two compression springs 18 pull back the rods 16 and 16' and thereby retract the seal bars 9, 8 away from the floor 14 and the supporting track 2, respectively. Then the wall elements may easily be slid along the track 2.

As explained in greater detail in the parent application U.S. Ser. No. 08/246,821, a vertical wall of the room in which the partition wall is to be deployed includes a wall connection jamb having a pneumatic tap valve to provide compressed air to the wall elements of the partition wall. A compressed air source such as a compressor provides compressed air to the pneumatic tap valve. The manner of deploying the wall elements to form a partition wall is also described in the parent application. When adjacent wall elements are pushed together, the tapered rail 56 of each wall element mates with the correspondingly inclined seal strips 44 of the adjacent wall element and thereby provides a guiding function to smoothly guide the engagement and proper vertical alignment of successive adjacent wall elements, so that it is not necessary to provide a guide track along the floor.

Figure 3:
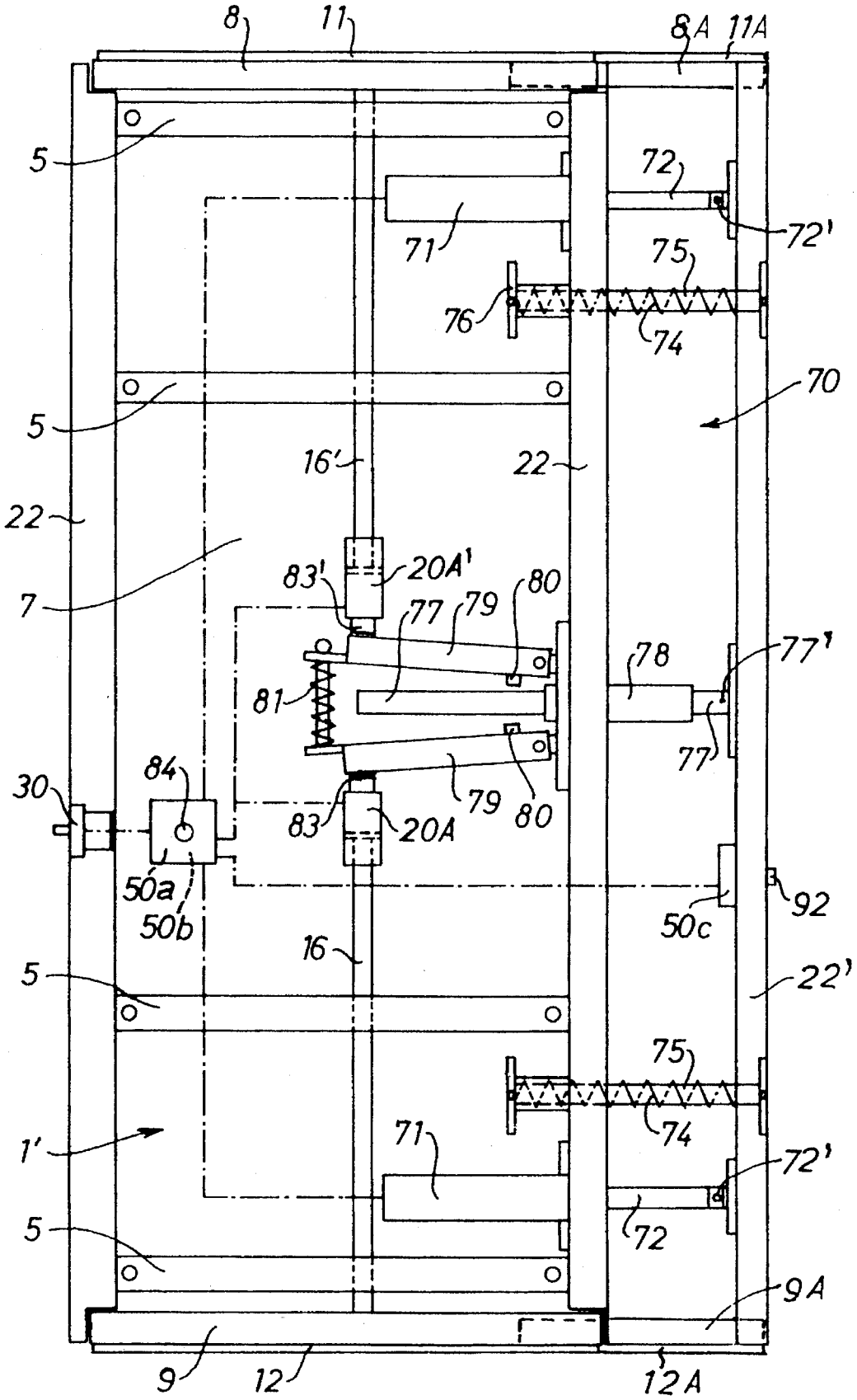
FIG. 3 is a schematic front view of a terminal wall element including a sliding termination panel in a retracted position, wherein the cover panel of the wall element has been omitted for clarity.

As shown in FIG. 1, the terminal wall element 1' has a different construction than the other wall elements 1, while many structural features are common as described above. The wall element 1' is, for example, the last or terminal wall element of a partition wall, closest adjacent the permanent wall 85 of a room that is to be partitioned. The wall element 1' includes a telescopically extendable, pneumatically actuatable sliding termination panel 70. In FIG. 3, the cover panel 6 of the wall element 1' has been omitted for clarity, but it should be understood that the cover panel 6 can extend over the area of the termination panel 70 in its retracted position as shown in FIG. 3. Alternatively, an outer cover panel of the termination panel can telescope outside of the cover panel of the wall element body. Thus, the termination panel 70 retracts telescopically within the wall element 1' to achieve a neat appearance and avoid the formation of a gap between the wall element body and the termination panel even when the termination panel is fully extended.

In order to slidingly extend the termination panel, preferably two horizontally effective cylinders 71 with cooperating piston rods 72 arranged therein are provided near the top and the bottom of the side edge of the wall element 1'. The piston rods 72 are rigidly connected to the sliding termination panel 70. Alternatively, the piston rods 72 may be connected by journal pins 72' to the termination panel 70, so that the termination panel 70 can adapt itself to slightly mis-aligned or out-of-plumb walls 85. Pretensioned springs 74 guided along spring guides 75 are provided to retract the sliding termination panel 70 once the extension cylinders 71 are decompressed.

As further shown in FIG. 3, in the central area of wall element 1', a horizontal guide rod 77 is rigidly secured to the termination panel 70. Alternatively, the guide rod 77 can be attached to the panel 70 by a journal pin 77', to enable the angular adjustability of the panel 70 as described above. The horizontal guide rod 77 slides or glides in a guide sleeve 78 rigidly attached to the wall element 1'. Furthermore, the guide rod 77 cooperates with a braking linkage comprising two tiltably arranged brake levers 79 arranged facing one another on opposite sides of said rod 77. Respective brake shoes 80 are arranged on the two brake levers 79 to selectively engage the guide rods 77 to achieve a braking effect thereon. A compression spring 81 is arranged at the free ends of the braking levers 79, so as to bias or urge the braking levers 79 away from one another.

Instead of a stroke device 20 as described above for the wall elements 1, the wall element 1' includes a two-part stroke device, namely a pair of pneumatically actuatable stroke devices 20A and 20A', which each cooperate with or actuate one of the brake levers 79 as described below. Similarly to the stroke device 20 described above, the two stroke devices 20A and 20A' are actuated by compressed air to extend the linkage rods 16 and 16' so as to respectively extend the seal bars 9 and 8 against the floor and the ceiling guide track. The rods 16 and 16' are loosely guided within the horizontal frame or support members 5 of the wall element 1'. The stroke devices 20A and 20A' are merely supported or held on the respective rods 16 and 16' in a free-floating manner, i.e. the stroke devices 20A and 20A' are not rigidly connected to or supported in the wall element 1'. The stroke devices may further be laterally guided by support members as shown in FIG. 2. Alternatively, an outer cylinder or sleeve of the respective stroke devices 20A and 20A' can be rigidly supported relative to the wall element 1', while two pistons extend freely from the two opposite ends of each of the stroke devices 20A and 20A'.

The above described free-floating arrangement achieves the following. When the stroke devices 20A and 20A' are actuated with compressed air, they first extend the linkage rods 16 and 16' as described above. Then, once the seal bars 9 and 8 have been fully extended, the devices 20A and 20A' further press a respective pressing head 83 and 83' against a respective one of the brake levers 79. To ensure this sequence of operation, it is simply necessary that spring 81 is stronger than springs 18. Thus, once the seal bars 9 and 8 have been fully extended into their sealing positions, the brake shoes 8 are tightly clamped against the horizontal guide rods 77 so that the slidable termination panel 70 is held in its extended position. This ensures that the termination panel 70 will be held in its extended position even if the extension cylinders 71 have a slight leakage decompression over long periods of time.

Figure 7:
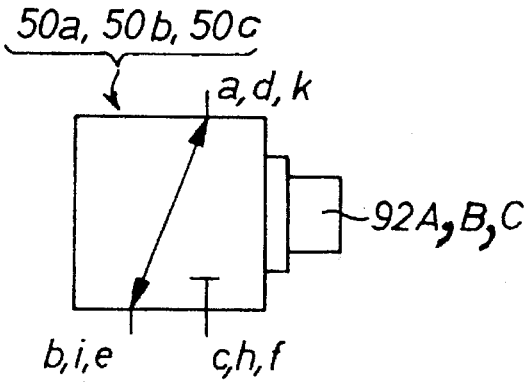
FIG. 7 is a schematic switching diagram for the pneumatic valves, showing an actuated state.
Figure 6:
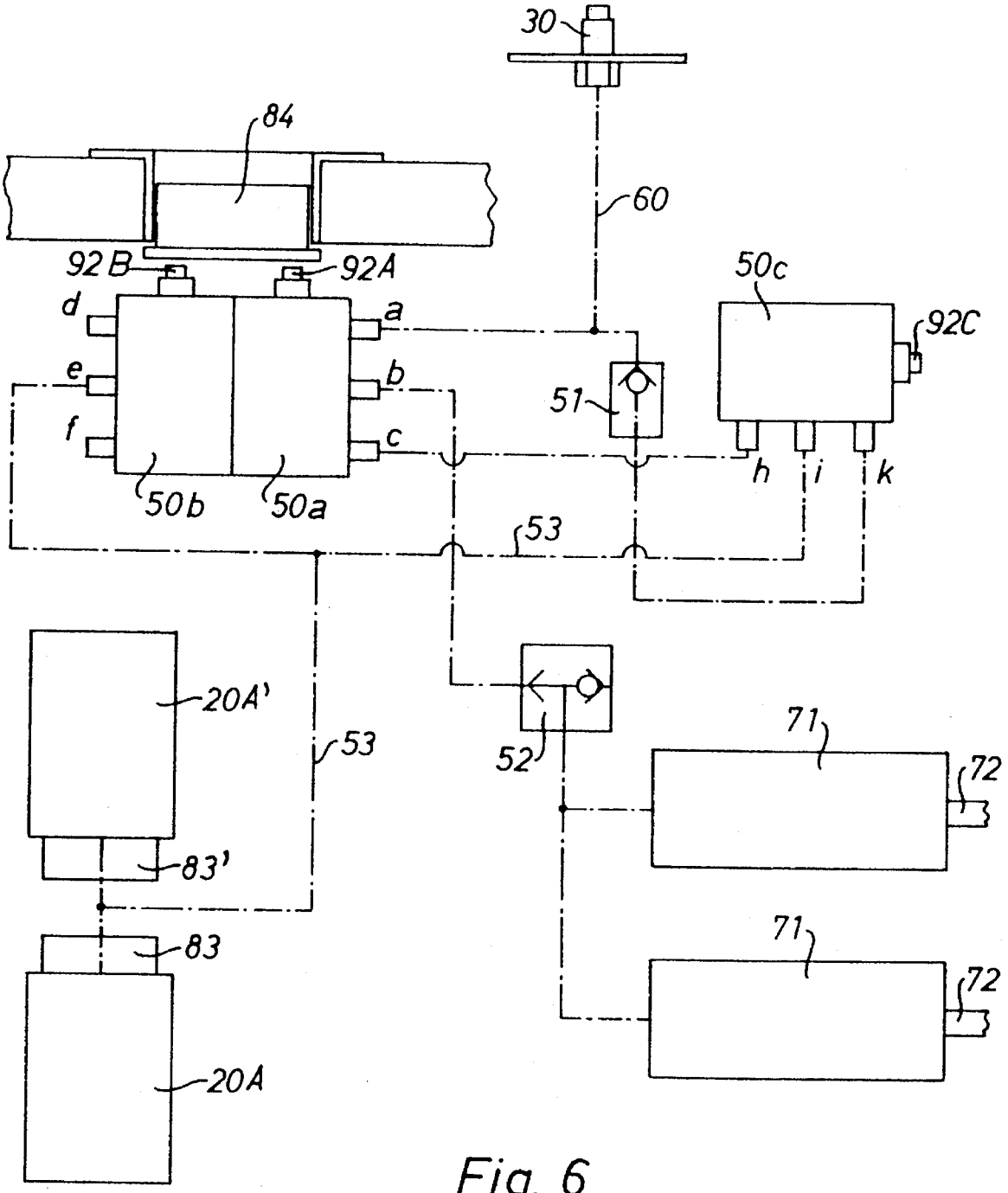
FIG. 6 is a schematic representation of a pneumatic circuit diagram.

As shown in FIG. 3, a manually operable control knob or button 84 is provided on the wall element 1' to actuate control valves that control the extension of the sliding termination panel 70 and the seal bars 9 and 8 as will be described in the following. FIG. 6 schematically shows a pneumatic circuit diagram. FIG. 7 shows the valve switching pattern and the connection points of each of three valves 50A, 50B and 50C, or any greater number of valves up to 50Z. Each of the valves has the same construction. As shown especially in FIG. 6, depressing the actuator button 84 in turn depresses the actuator pins 92A and 92B of two valves 50A and 50B. The valve 50C is arranged on the laterally extending edge of the termination panel 70 to form an extension limit valve 50C, whereby contacting the wall 85 will actuate or depress the actuator pin 92C. FIG. 7 shows the state of the valves when the actuator pins 92 are depressed, namely valve port A is connected to valve port B of valve 50A, valve port D is connected to valve port E of valve 50B, and valve port K is connected to valve port I of valve 50C.

When the last wall element 1' having the termination panel 70 is pushed against the next adjacent wall element 1, the coupling valve 30 is opened to allow compressed air to flow into the pneumatic system of the wall element 1' as has already been described above. However, the valves 50A and 50B control or prevent the flow of compressed air. Only once the control button 84 is depressed, the compressed air is directed to the extension cylinders 71 to extend the sliding termination panel 70. More specifically, the compressed air enters port A and then exits port B of valve 50A and then passes through a rapid decompression or venting valve 52, and from there to the extension cylinders 71. For the time being, the vent opening of the valve 52 remains closed.

Compressed air from the coupling member 30 also passes through a branch conduit through a one-way or non-return valve 51 to port K of the limit valve 50C.

At this stage, the compressed air pressurizes the extension cylinders 71 so that the piston rods 72 drive the termination panel 70 outward away from the wall element 1' and up against the stationary wall 85 of the room to be partitioned. Thereby, the termination panel 70 closes the vertical gap 86 between the wall element 1' and the stationary wall 85 of the room. The vertical gap 90 between the adjacent wall elements 1' and 1 as shown in FIG. 1 has previously already been closed by manually sliding the wall element 1' laterally against the wall element 1 so as to engage the coupling valves 30 and 32 as described above.

Once the actuator pin 92C of the limit valve 50C contacts the wall 85, which forms a mechanical stop or end limit, the valve 50C switches over to connect ports K and I as shown in FIG. 7, so that compressed air flows through conduit 53 to the two stroke devices 20A and 20A'. Thereby, the stroke devices 20A' and 20A press the two seal bars 8 and 9 respectively against the guide track 2 and the floor 14 as described above. Once that has occurred, the pressing heads 83 and 83' of the stroke devices 20A and 20A' respectively press the two levers 79 toward one another while overcoming the force of spring 81, so as to press the brake shoes 80 against the horizontal guide rod 77 and thereby lock or arrest the extended position of the sliding termination panel 70. Thus, the pneumatic actuation necessarily occurs in the following sequence: once the actuator button 84 is depressed, first the termination panel 70 is extended fully until it firmly seals against the wall 85, next the stroke devices 20A and 20A' extend the seal bars into the sealing positions, and finally the extended position of the panel 70 is fixed by braking action.

In order to depressurize the pneumatic circuit and thereby retract the termination panel 70 and the seal bars 8 and 9, first the compressed air supply from the compressor is interrupted and then the control or actuator button 84 is depressed. Thereby, the pressure in the supply line 60 decreases, and since the ports A and B of valve 92A are now connected to one another, the decompression valve 52 is opened so that air can escape and the extension cylinders 71 are retracted, along with the termination panel 70 under the spring force of the retraction springs 74. Simultaneously, the compressed air is released out of the stroke devices 20A and 20A', whereupon the seal bars 9 and 8 are retracted so that the wall element 1' may easily be slid or rolled along the guide track 2.

As a further optional feature, seal elements can be provided along the top and bottom edges of the sliding termination panel 70 to ensure that the noise insulating seal of the partition wall is not disrupted at the area of the termination panel. For example, as shown in FIG. 1, a flexible skirt 70A, which may be a rubber skirt or a brush bristle skirt, can be arranged along the top and bottom edges of the termination panel 70. FIG. 3 shows another optional alternative, wherein an auxiliary seal bar 8A with an auxiliary seal strip 11A is arranged at the top of the termination panel 70. The seal bar 8A and seal strip 11A function substantially similarly to the seal bar 8 and seal strip 11. Another auxiliary seal bar 9A with an auxiliary seal strip 12A is arranged at the bottom of the termination panel.

The auxiliary seal bars 9A and 8A extend telescopic laterally into the seal bars 9 and 8 respectively. In other words, in the view of FIG. 3, the auxiliary seal bars 9A and 8A form an extension of the hollow seal bars 9 and 8 respectively. The auxiliary seal bars 9A and 8A are connected to the frame structure 22' and are therefore moved together with the termination panel 70. The auxiliary seal bars 9A and 8A are movably connected in a vertical direction relative to the frame structure 22', for example by a screw head engaging a vertical slot in the frame structure 22'. In this manner, a continuous tight seal is formed along the floor and the ceiling with substantially no gaps therein, regardless of the final deployed position of the sliding termination panel 70.

Although the invention has been described with reference to specific example embodiments, it will be appreciated that it is intended to cover all modifications and equivalents within the scope of the appended claims.

What is claimed is:

1. A wall element for a mobile partition wall adapted to be arranged in a room having a wall, said wall element comprising a wall element body having first and second side edges and top and bottom edges, a pneumatic coupling arranged at said first side edge, a termination panel arranged at said second side edge and movably connected to said wall element body to be laterally slidable relative thereto, a manually actuatable pneumatic control valve, at least one horizontally effective pneumatic stroke device mechanically connected between said wall element body and said termination panel and pneumatically connected through said control valve to said pneumatic coupling, and an extension limit valve arranged at a laterally outer side edge of said termination panel so as to be actuated by contact with the room wall, wherein said control valve has a pneumatic switching characteristic so that a compressed air flow can pass from said pneumatic coupling to said pneumatic stroke device only when said control valve is actuated.

2. The wall element of claim 1, further comprising at least one flexible seal strip arranged along a top edge or a bottom edge of said sliding termination panel.

3. The wall element of claim 1, wherein said pneumatic coupling includes a tapered guide member having two planar guide surfaces that are oppositely inclined relative to the major plane of said wall element.

4. The wall element of claim 1, wherein said wall element further comprises at least one vertically movable seal member arranged at said top edge or at said bottom edge of said wall element body, and a vertically effective pneumatic stroke device mechanically connected to said seal member and pneumatically connected to said pneumatic coupling through at least one of said control valve and said extension limit valve, and wherein said extension limit valve has a pneumatic switching characteristic so that a compressed air flow can pass from said pneumatic coupling to said vertically effective pneumatic stroke device only when said extension limit valve is actuated.

5. The wall element of claim 1, comprising two of said horizontally effective pneumatic stroke devices, wherein each of said horizontally effective pneumatic stroke devices is a piston-cylinder device.

6. The wall element of claim 1, wherein said termination panel is arranged to extend telescopically from said wall element body, without a gap through said wall element between said wall element body and said termination panel for all extension positions of said termination panel.

7. A wall element for a mobile partition wall adapted to be arranged in a room having a wall, said wall element comprising a wall element body having first and second side edges and top and bottom edges, a pneumatic coupling arranged at said first side edge, a termination panel arranged at said second side edge and movably connected to said wall element body to be laterally slidable relative thereto, a manually actuatable pneumatic control valve, at least one horizontally effective pneumatic stroke device mechanically connected between said wall element body and said termination panel and pneumatically connected through said control valve to said pneumatic coupling, an extension limit valve arranged at a laterally outer side edge of said termination panel, at least one vertically movable seal member arranged at said top edge or at said bottom edge of said wall element body, and at least one vertically effective pneumatic stroke device mechanically connected to said seal member and pneumatically connected to said pneumatic coupling through at least one of said control valve and said extension limit valve.

8. The wall element of claim 6, wherein said pneumatic coupling includes a tapered guide member having two planar guide surfaces that are oppositely inclined relative to the major plane of said wall element.

9. The wall element of claim 7, comprising a top one and a bottom one of said vertically movable seal members, respectively arranged at said top edge and said bottom edge.

10. The wall element of claim 9, wherein said vertically effective pneumatic stroke device comprises a single pneumatic stroke element connected to both said top and bottom seal members by respective oppositely extending linkage rods.

11. The wall element of claim 9, wherein said vertically effective pneumatic stroke device comprises two independent pneumatic stroke elements, wherein each of said stroke elements is connected to a respective one of said seal members.

12. The wall element of claim 11, further comprising two linkage rods respectively connecting said stroke elements to said seal members, wherein each of said stroke elements is mounted in a non-rigid free-floating manner within said wall element body.

13. The wall element of claim 11, further comprising a brake mechanism actuatable by at least one of said pneumatic stroke elements to fix a position of said termination panel relative to said wall element body.

14. The wall element of claim 13, further comprising a horizontal guide rod connected to said sliding termination panel to be horizontally slidable relative to said wall element body, wherein said brake mechanism comprises a brake lever arranged to be pivotable relative to said wall element body and to be pivotally driven into braking contact with said guide rod by said at least one of said stroke elements.

15. The wall element of claim 7, further comprising a brake mechanism actuatable by said vertically effective stroke device to fix a position of said termination panel relative to said wall element body.

16. The wall element of claim 15, further comprising a horizontal guide rod connected to said sliding termination panel to be horizontally slidable relative to said wall element body, wherein said brake mechanism comprises a brake lever arranged to be pivotable relative to said wall element body and to be pivotally driven into braking contact with said guide rod by said vertically effective stroke device.

17. A wall element for a mobile partition wall adapted to be arranged in a room having a wall, said wall element comprising a wall element body having first and second side edges and top and bottom edges, a pneumatic coupling arranged at said first side edge, a termination panel arranged at said second side edge and movably connected to said wall element body to be laterally slidable relative thereto, a manually actuatable pneumatic control valve, at least one horizontally effective pneumatic stroke device mechanically connected between said wall element body and said termination panel and pneumatically connected through said control valve to said pneumatic coupling, at least one vertically movable primary seal member arranged at said top edge or at said bottom edge of said wall element body, and at least one vertically movable auxiliary seal member arranged at a top edge or a bottom edge of said sliding termination panel telescopically engaging with said primary seal member and connected to said termination panel to be movable therewith in a horizontal direction, wherein said termination panel is arranged to extend telescopically from said wall element body, without a gap through said wall element between said wall element body and said termination panel for all extension positions of said termination panel.

18. The wall element of claim 17, wherein said auxiliary seal member reaches telescopically into said primary seal member.

19. The wall element of claim 17, wherein said pneumatic coupling includes a tapered guide member having two planar guide surfaces that are oppositely inclined relative to the major plane of said wall element.

20. A mobile partition wall comprising a support track mounted on the ceiling of a room and a plurality of wall elements, wherein each of said wall elements comprises a wall element body having first and second side edges and top and bottom edges, at least one first pneumatic coupling arranged at said first side edge, at least one vertically movable seal member arranged at said top edge or said bottom edge and a vertically effective pneumatic stroke device mechanically connected to said seal member and pneumatically connected to said pneumatic coupling, and wherein at least one of said wall elements is a terminal wall element that further comprises a termination panel arranged at said second side edge of said terminal wall element and movably connected to said terminal wall element body to be laterally slidable relative thereto, a manually operable pneumatic control valve, a horizontally effective pneumatic stroke device mechanically connected between said terminal wall element body and said termination panel and pneumatically connected through said control valve to said pneumatic coupling, and an extension limit valve arranged at a laterally outer side edge of said termination panel so as to be actuated by contact with a wall of the room, wherein said control valve has a pneumatic switching characteristic so that a compressed air flow can pass from said pneumatic coupling of said terminal wall element to said horizontally effective pneumatic stroke device only when said control valve is actuated, and said extension limit valve has a pneumatic switching characteristic so that a compressed air flow can pass from said pneumatic coupling of said terminal wall element to said vertically effective pneumatic stroke device only when said extension limit valve is actuated.

21. The mobile partition wall of claim 20, further comprising a second pneumatic coupling arranged at said second side edge of said wall element body, wherein said first pneumatic coupling comprises a pneumatic valve and a first tapered rail member having two substantially planar guide flanks that extend vertically and inclined outwardly from each other around said pneumatic valve, and wherein said second pneumatic coupling comprises a coupling bolt adapted to cooperate with said pneumatic valve when said first and second couplings of two adjacent ones of said wall elements are in coupling engagement and a second tapered rail member having two substantially planar guide flanks adapted to mate with said first tapered rail member when said first and second couplings of said two adjacent ones of said wall elements are in coupling engagement.

* * * * *